United States Patent [19]

Bis et al.

[11] Patent Number: 4,709,434

[45] Date of Patent: Dec. 1, 1987

[54] DEVICE FOR CONTROLLING MOVEMENT OF A COPYING ROLLER

[75] Inventors: Josef Bis; Antonin Petrzelka, both of Gottwaldov, Czechoslovakia

[73] Assignee: Tovarny Strojirenske Techniky Koncern, Prague, Czechoslovakia

[21] Appl. No.: 874,130

[22] Filed: Jun. 13, 1986

[30] Foreign Application Priority Data

Jun. 13, 1985 [CS] Czechoslovakia ..... 4261-85

[51] Int. Cl.[4] ..... A43D 95/00; C14B 1/44

[52] U.S. Cl. ..... 12/77; 69/6.5

[58] Field of Search ..... 12/70, 70.5, 77, 78, 12/79.2, 79.3, 77.5, 1 R; 69/6.5

[56] References Cited

U.S. PATENT DOCUMENTS

| | | | |
|---|---|---|---|
| 3,932,907 | 1/1976 | Vornberger | 12/77 |
| 4,134,278 | 1/1979 | Becka | 69/6.5 |
| 4,324,118 | 4/1982 | Bruggi | 69/6.5 |
| 4,416,031 | 11/1983 | Shutt et al. | 69/6.5 |
| 4,452,057 | 6/1984 | Davies et al. | 69/6.5 |
| 4,555,823 | 12/1985 | Pedrem et al. | 69/6.5 |
| 4,561,139 | 12/1985 | Becka et al. | 69/6.5 |

*Primary Examiner*—Henry S. Jaudon
*Assistant Examiner*—Steven N. Meyers

[57] ABSTRACT

A device for improving the control of the correction movement of the copying roller of a machine for roughening a margin of a tightened shoe upper comprises a holder of the copying roller which is slidably seated in the basic body of a treating head and connected to a motion gear controlled by means of electric circuits according to a selected program. The correction movement of the holder with the copying roller is controlled by electric circuits, which switches, according to the preselection of code switches, the selected combination of electromagnetic valves of distributors of respective pressure cylinders. The sequence of switching of selected combinations of the electromagnetic valves is determined by switching one of two selecting switches, which control the working cycle of the roughening of the lasting margin of the left shoe or the right one. The whole value of the correction movement of the holder results from the sum of movements of pistons of pressure cylinders. The invention may be used in machines for roughening a lasting margin of a tightened shoe upper.

3 Claims, 4 Drawing Figures

DEVICE FOR CONTROLLING MOVEMENT OF A COPYING ROLLER

This application is related to coassigned copending application Ser. Nos: 849,748, filed Apr. 9, 1986; 849,749, filed Apr. 9, 1986; and 843,980, filed Mar. 25, 1986 which issued as U.S. Pat. No. 4,649,585 on Mar. 17, 1987, and the disclosures of these copending applications are incorporated herein by reference.

BACKGROUND OF THE INVENTION

The invention relates to a device for controlling movement of a copying roller of a machine for roughening a lasting margin of a tightened shoe upper, comprising a holder of the copying roller, which is slidably seated in a basic body of a treating head and connected to a motion mechanism controlled by electric circuits according to a determined program.

There are known machines for roughening a lasting margin of a tightened shoe upper, where a rotating tool for making a surface rough is guided by a copying roller, which rolls on the side circumference surface of a treated shoe semi-product. The lasting margin of the shoe upper has a sufficient width in different parts of the circumference of the lower surface of the shoe semi-product, but in spite of this it is necessary to roughen the entire width of the margin. An insufficient roughening of the lasting margin causes an insufficient strength of the joint of the glued sole. Thus it is necessary to correct the mutual position of the machine for roughening the surface and the copying roller so that the lasting margin of the shoe upper may be roughened all over the whole circumference in the whole width up to the line of the boundary of the lower surface and of the side circumference surface of the shoe semi-product. Usually it is sufficient to correct the position of the copying roller for four parts of the circumference of the lasting margin of the shoe upper, viz. for the heel part, external side part, toe cap part and internal side part. These parts form the whole circumference of the lasting margin of the shoe upper and in each of them the width of the lasting margin is in fact constant.

Known solutions for correcting movement of a copying roller utilize an electro-hydraulic servomechanism with a continuous setting up of the correction by means of potentiometers. This solution suits the requirements of the technology of shoe production, but it is rather complicated, and costly. Moreover this solution requires frequent maintenance which disturbs the continuous production of shoes.

SUMMARY OF THE INVENTION

It is an object of this invention to provide a device for controlling movement of a copying roller according to the invention in which the disadvantages of the prior art are eliminated or at least mitigated. The principle of the invention resides in that the basic body of the treating head for roughening the surface is connected by means of a swing arm to a machine frame and a holder of the copying roller is terminated by a head, in which there is seated a cylindrical body with two pressure cylinders. A piston of one of the said cylinders is connected by means of a common piston rod to a piston of a third pressure cylinder, which is connected by means of a yoke to the basic body. The pressure cylinders are individually connected to distributors of a pressure medium, and electromagnetic valves of these distributors are individually connected to outlets of four code switches designed for preselection of corrections in parts of the circumference of the treated lasting margin of the shoe upper. Two code switches are connected by their inputs through a changeover switch to first outputs of flip-flops and controlled by selecting switches through an RS circuit. The other two code switches are connected by their inputs directly to first outputs of flip-flops. The flip-flops form a common shift register, where their first outputs are connected to following first inputs, and their second outputs are connected to following second inputs, and the set input of the first flip-flop is parallelly connected to the reset inputs of following flip-flops by means of an input branch, to which there is connected the output of a first product gate. The inputs of the first product gate are connected both to outputs of the selecting switches and to the inputs of the RS circuit. Clock inputs of the flip-flops are interconnected to a collecting branch, to which there is connected the output of a shaping circuit, the input of which shaping circuit is connected to the output of a second product gate. Position switches are connected to the inputs of the second product gate, and for them position elements are arranged on bars of a carriage of the treated shoe semi-product.

Values of piston strokes of pressure cylinders are of proportions 1:2:4.

The Electromagnetic valves are connected to outlets of the code switches through transistor switches and through diodes.

An advantage of the invention is that by combination of piston strokes of three pressure cylinders, eight different values of a movement correction of the copying roller can be achieved, which is fully sufficient for roughening the lasting margin of the shoe upper in the determined width all over its circumference. Values of piston strokes of pressure cylinders in proportions 1:2:4 provide advantageous combinations of values of the movement correction of the copying roller. An RS circuit in cooperation with a changeover switch performs automatically a commutation of a determined sequence of switching of code switches. A proper activation of code switches is secured by flip-flops of a shift register after having switched selecting switches or position switches. The position switches are automatically controlled by position elements arranged on bars of a carriage of the treated semi-product of shoes. Transistor switches increase the service life of electric wiring. Diodes advantageously separate individual code switches. The device according to the invention is simple and inexpensive to manufacture and it is very reliable and easy to maintain, thus resulting in a continuous production of shoes.

BRIEF DESCRIPTION OF THE DRAWING

In order that the invention may be clearly understood and readily carried into effect, a preferred embodiment thereof is, by way of example, hereinafter more fully described and illustrated in the accompanying drawing, in which.

DESCRIPTION OF THE PREFERRED EMBODIMENT

Figure 1:
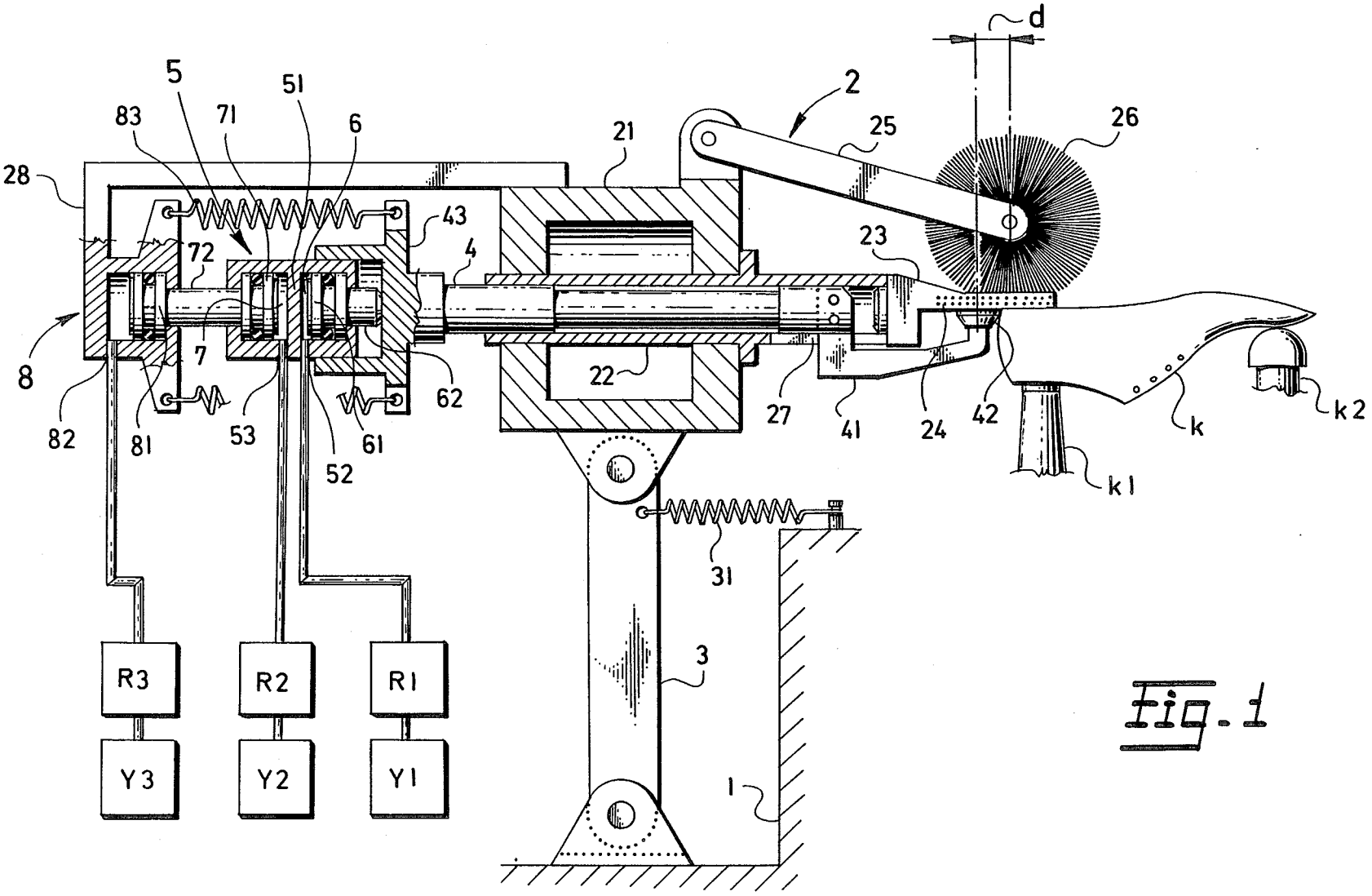
FIG. 1 shows a whole longitudinal section.

Referring to FIG. 1, a swing arm 3 is connected to a basic body 21 of a treating head 2, the other end of which swing arm 3 is seated in a frame 1 of an unshown machine for roughening the surface. In the basic body 21 there is pressed a bush 22, to the front part of which there is fixed a holder 23 of copying fingers 24. A supporting arm 25 of the treating brush 26 is connected to the basic body 21. The swing arm 3 is anchored in the frame 1 by means of a spring 31. In the bush 22 of the basic body 21 there is slidably seated a bar 4, to the front end of which there is fixed a second holder 41, which is pushed through a longitudinal groove 27 of the bush 22 and on the end of which a copying roller 42 is seated. The other end of the bar 4 is terminated by a head 43, in which a cylindrical body 5 is slidably seated. In the cylindrical body 5 there are separated by means of a partition 51, first and second pressure cylinders 6, 7, which are individually connected by means of first and second holes 52, 53 to first and second distributors R1, R2 of a pressure medium. In the first pressure cylinder 6 there is seated a first piston 61 with a first piston rod 62. A second piston 71 with a second piston rod 72 is seated in the second pressure cylinder 7. The basic body 21 is connected to the third pressure cylinder 8 by means of a yoke 28. A third piston 81 of the third pressure cylinder 8 is fixed onto the second piston rod 72 of the second pressure cylinder 7. The third pressure cylinder 8 is connected by third hole 82 to third distributor R3 of the pressure medium, and it is anchored by means of second springs 83 to head 43 of the bar 4. Under the treating brush 26 a last k of a semi-product of a treated shoe is seated on a heel support k1 and toe cap support k2 of an unshown carriage. The copying fingers 24 are in contact with the lower surface and by means of the copying roller 42 they are in contact with the side circumferential surface of the treated shoe semi-product.

Figure 2:
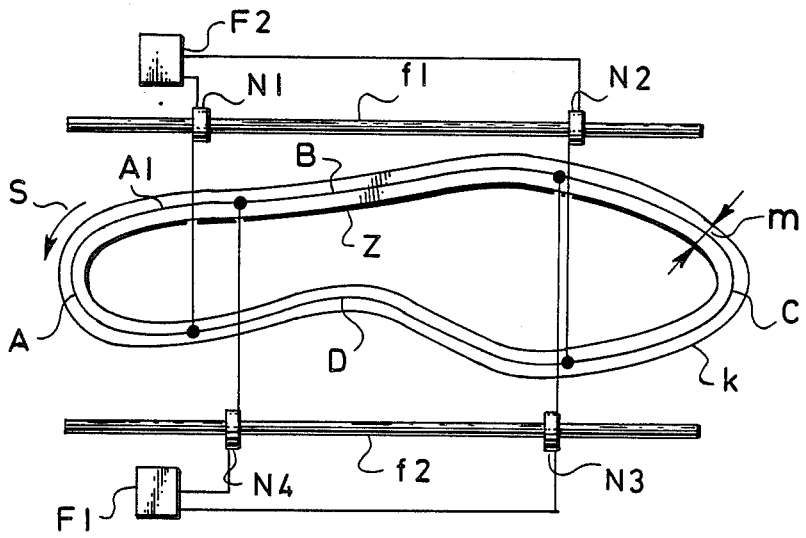
FIG. 2 shows a plan of a lower surface of a semi-product of a right shoe.
Figure 3:
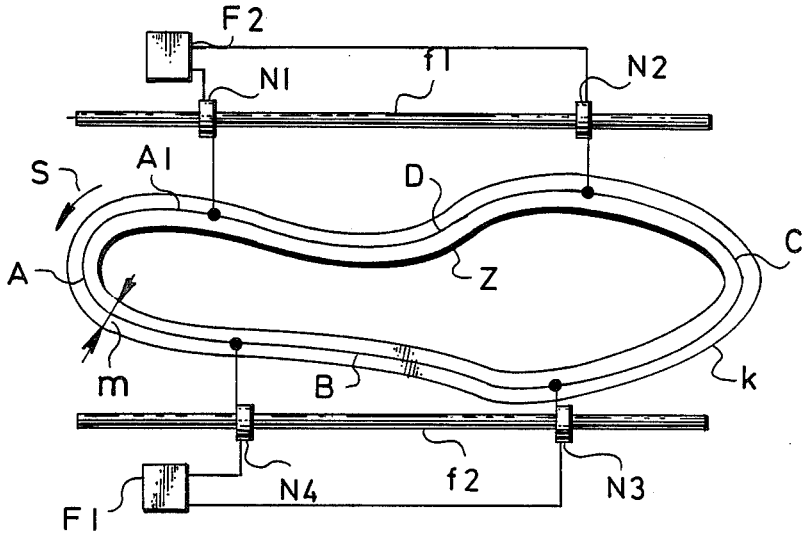
FIG. 3 shows a plan of a lower surface of a semi-product of a left shoe.

In the basic position shown in FIG. 1, all pressure cylinders 6, 7, and 8 are filled with the pressure medium and the bar 4 with the second holder 41 is in the front limit position, in which the center of the copying roller 42 has the basic distance d from the center of the treating brush 26. The basic distance d corresponds with the basic width of the treated lasting margin Z (FIGS. 2 and 3) of the tightened shoe upper. Referring to FIGS. 2 and 3, the whole circumference of the lasting margin Z of the shoe upper is divided to a heel part A, external side part B, toe cap part C and internal side part D.

Figure 4:
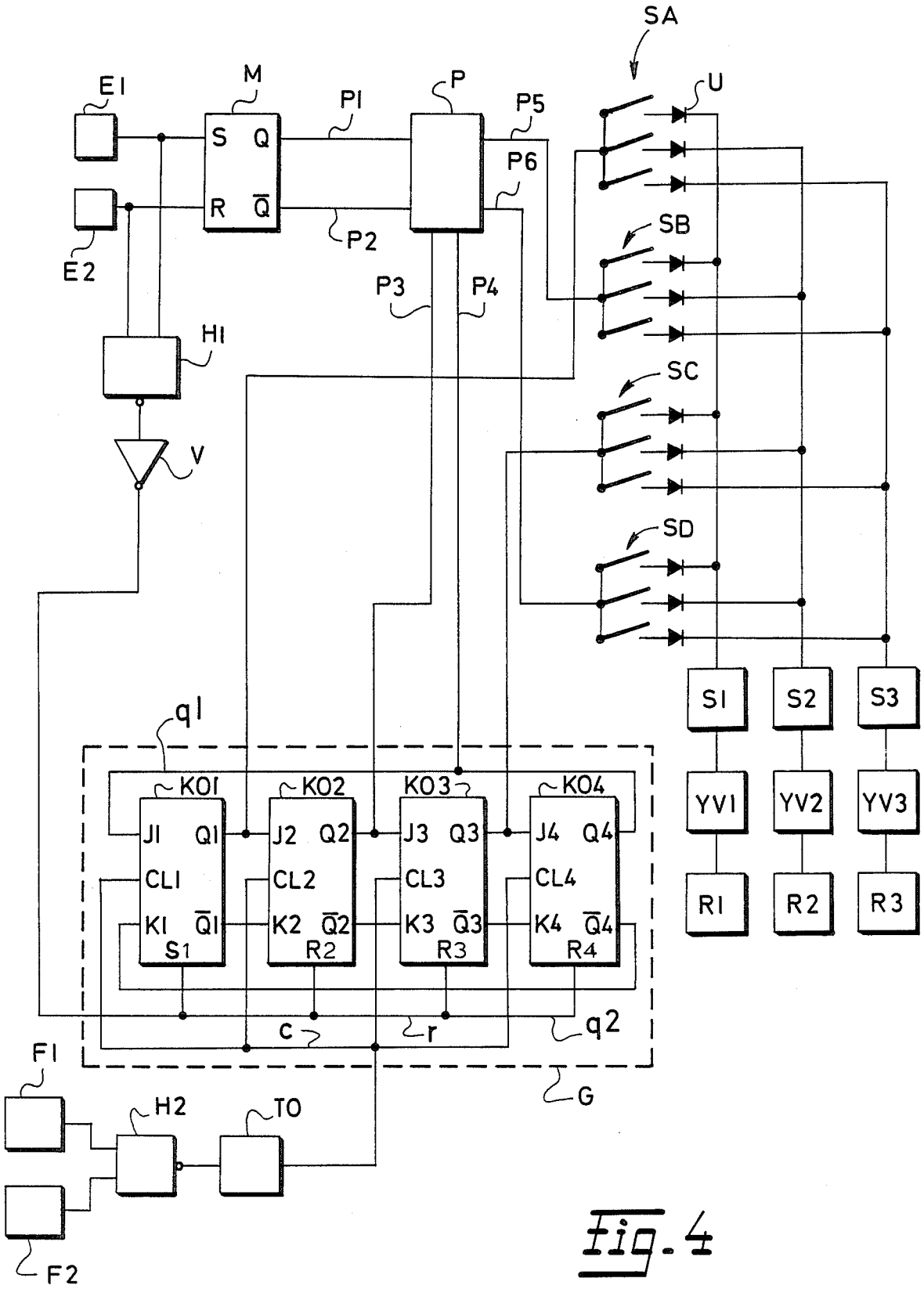
FIG. 4 shows a wiring diagram.

Referring now to FIG. 4, distributors R1, R2, and R3 of the pressure cylinders 6, 7, and 8 are individually connected to electromagnetic valves Y1, Y2, and Y3, which are individually connected through transistor switches S1, S2, S3 and separating diodes U to outputs of all four code switches SA, SB, SC, and SD, by means of which there is controlled the whole width of the treatment of the lasting margin Z of the tightened shoe upper in parts A, B, C, D of its circumference. That is, each code switch can be set to activate any one or combination of switches S1, S2, S3, thereby activating any combination of distributors R1, R2, R3, thereby activating movement of any combination of pistons 61, 71, 81.

The code switch SA, corresponding with the heel part A, is connected to the first output Q1 of first flip-flop KO1, which together with the second flip-flop KO2, third flip-flop KO3 and fourth flip-flop KO4 forms a shift register G. The code switch SC, corresponding with the toe cap part C, is connected to the first output Q3 of the third flip-flop KO3 of the shift register G. The code switch SB, corresponding with the external side part B, is connected to the first output P5 of changeover switch P, to the second output P6 of which is connected the code switch SD, which corresponds with internal side part D. To the first output Q2 of the second flip-flop KO2 of the shift register G there is connected the third input P3 of the changeover switch P, the fourth input P4 of which is connected to the first output Q4 of the fourth flip-flop KO4 of the shift register G, which is simultaneously by means of the first reverse branch q1 connected to the first input J1 of the first flip-flop KO1 of the shift register G.

In the shift register G the first output Q1 of the first flip-flop KO1 is connected to the first input J2 of the second flip-flop KO2, the first output Q2 of which is connected to the first input J3 of the third flip-flop KO3, the first output Q3 of which is connected to the first input J4 of the fourth flip-flop KO4. Analagously, the second output (not) Q1 of the first flip-flop KO1 is connected to the second input K2 of the second flip-flop KO2, the second output (not) Q2 of which is connected to the second input K3 of the third flip-flop KO3, the second output (not) Q3 of which is connected to the second input K4 of the fourth flip-flop KO4. The second output (not) Q4 of the fourth flip-flop KO4 is, by means of the second reverse branch q2, connected to the second input K1 of the first flip-flop KO1.

Clock inputs CL1, CL2, CL3, and CL4 for all four flip-flops KO1, KO2, KO3, and KO4 of the shift register G are parallelly connected to the collecting branch c. The set input S1 of the first flip-flop KO1 is parallelly connected by means of the supply branch r to reset inputs R2, R3, and R4 of the second flip-flop KO2, third flip-flop KO3 and fourth flip-flop KO4. To the supply branch r there is connected an invertor V, to which the first product gate H1 is connected.

The first output Q of the RS circuit (RS flip-flop) M is connected to the first input P1 of the changeover switch P and the second output (not) Q of the RS circuit is connected to the second input P2 of the changeover switch P. The output of the first selecting switch E1 is connected both to the first input S of the RS circuit and to one input of the first product gate H1. The output of the second selecting switch E2 is connected to both the second input R of the RS circuit and to the second input of the first product gate H1. The first selecting switch E1 is designed for switching a working cycle of roughening the lasting margin Z of the tightened upper of the right shoe. The other selecting switch E2 is designed for switching the working cycle of the roughening of the lasting margin Z of the tightened upper of the left shoe.

To the collecting branch c of the clock inputs CL1, CL2, CL3, and CL4 of the flip-flops KO1, KO2, KO3, and KO4 of the shift register G there is connected the output of a shaping circuit TO, to the input of which there is connected the output of the second product gate H2. To one input of the second product gate H2 there is connected the output of the first position switch F1. To the second input of the second product gate H2 there is connected the output of the second position switch F2. The position switches F1, F2, are activated by position elements N1, N2, N3, and N4, which are adjustably arranged on bars f1, f2, which are seated on the unshown carriage of the heel k of the treated shoe semi-product. See FIGS. 2 and 3.

Referring to FIGS. 2 and 3, the last k of the shoe semi-product moves during roughening the lasting margin Z of the shoe upper by an action of the unshown carriage by a combination of rotary movements and shifting ones. At first, the last turns through 180° and during this movement the whole heel part A is roughened, then during the first shifting movement, one of the side parts B or D is roughened, then the second turning of the last through 180° takes place during which the toe cap part C is roughened, and finally during the reverse shifting movement of the last k, the other side part D or B is roughened as well as any remaining section of the heel part A. The working cycle of the roughening of the lasting margin Z of the shoe upper proceeds always in the direction S as shown and it starts always in the initial point A1, which takes place on the left side of heel part A, on the lower surface of the shoe semi-product in the direction from the heel to the toe cap, whether it be for the left shoe or the right one. That is why the lasting margin Z of the right shoe (FIG. 2) is roughened in sequence of parts A, D, C, B, and the lasting margin of the left shoe (FIG. 3) is roughened in the sequence of parts A, B, C, D.

During the working cycle, the copying roller 42 remains in permanent contact with the periphery of the lasted shoe k. By connecting the code switches SA, SB, SC, SD, the pressurized medium is let out of the pressure cylinders 6, 7, 8 according to a corresponding combination whereupon, due to the action of spring 83, the bar 4 is displaced to the left by a value of shifting correction of the copying roller 42 as indicated hereinbelow in the table for chosen code switch combinations. The distance d between the axis of the treating brush 26 and the axis of the copying roller 42 changes according to the value of the shifting correction. Due to the action of spring 31 on the basic body 21, via swing arm 3, the copying roller 42 remains in contact with the periphery of the lasted shoe k so that the motion of the axis of the brush 26 results in a displacement of the brush relative to the lasting margin of the treated shoe k.

Referring again to FIGS. 4 and 1, each code switch SA, SB, SC, SD, may be set by a manual preselection in eight various positions 0 up to 7 (a 3 bit code); each position corresponding to a combination of electromagnetic valves Y1, Y2, and Y3. Values of strokes of pistons 61, 71, 81, of pressure cylinders 6, 7, 8 are in proportions 1:2:4 which provides for an advantageous shifting correction of the copying roller as will be seen. In the preferred embodiment of the device, the stroke of the piston 61 of the first pressure cylinder 6 is 2 mm, the stroke of the piston 71 of the second pressure cylinder 7 is 4 mm and the stroke of the piston 81 of the third pressure cylinder 8 is 8 mm. Values of the resulting shifting correction of the copying roller 42 with different chosen combination of switching of electromagnetic valves Y1, Y2, Y3 are shown in the table below:

| Chosen combination of of code switch | Logic level of signals for switching el.mag.valves | | | Stroke of pistons of pressure cylinders | | | Shifting correction of the copying roller |
|---|---|---|---|---|---|---|---|
| | Y1 | Y1 | Y3 | 6 | 7 | 8 | |
| 0 | L | L | L | 0 | 0 | 0 | 0 |
| 1 | H | L | L | 2 | 0 | 0 | 2 |
| 2 | L | H | L | 0 | 4 | 0 | 4 |
| 3 | H | H | L | 2 | 4 | 0 | 6 |
| 4 | L | L | H | 0 | 0 | 8 | 8 |
| 5 | H | L | H | 2 | 0 | 8 | 10 |

-continued

| Chosen combination of of code switch | Logic level of signals for switching el.mag.valves | | | Stroke of pistons of pressure cylinders | | | Shifting correction of the copying roller |
|---|---|---|---|---|---|---|---|
| | Y1 | Y1 | Y3 | 6 | 7 | 8 | |
| 6 | L | H | H | 0 | 4 | 8 | 12 |
| 7 | H | H | H | 2 | 4 | 8 | 14 |

The preselection of the combination for switching the electromagnetic valves Y1, Y2, and Y3 may be changed by a manual setting of the code switches SA, SB, SC, SD even during the course of the working cycle of roughening of the lasting margin Z of the shoe upper. The changeover switch P in cooperation with the RS circuit M secures the desired commutation of switching of code switches during roughening of the surface of the right shoe in the sequence SA, SD, SC, SB and during the roughening of the left shoe in the sequence SA, SB, SC, SD. The beginning of individual parts A, B, C, D of the circumference of the lasting margin Z of the shoe upper are determined by switching the position switch F1 or F2 by the function of the respective position element N1, N2, N3, and N4. (See FIGS. 2 and 3) The shaping circuit TO shapes clock pulses for clock inputs CL1, CL2, CL3, and CL4 of the flip-flops KO1, KO2, KO3, and KO4 of the shift register G on the basis of the switching of the position switch F1 or F2. The input logic level of the shaping circuit TO is maintained by means of internal coupling for a longer time than the time of switching of position switches F1, F2.

EXAMPLE

Let us suppose that the operator of the machine selected, for treating the part A of the circumference of the lasting margin Z of the shoe upper, on the code switch SA the combination No. 2, for treating the part B, on the code switch SB the combination No. 1, for treating the part C, on the code switch SC the combination No. 6, and for treating the part D, on the code switch SD the combination No. 4.

For roughening the lasting margin Z of the right shoe upper, the operator switches the first selecting switch E1. In this way the unshown carriage of the last k of the semi-product of the treated shoe is put in a rotating motion, and simultaneously there is supplied a signal of the level L to the first input S of the RS circuit M, which is in this way transferred so that on the first output Q is a signal of the level H and on the second output (not) Q is a signal of the level L. In this way, the changeover switch P is changed over so that a signal of the level H from the first output Q2 of the second flip-flop KO2 may pass through its third input P3 to the second output P6 and then to the input of the fourth code switch SD. Simultaneously a signal of the level H may pass from the first output Q4 of the fourth flip-flop KO4 to the first output P5 of the changeover switch P and then to the input of the second code switch SB. A signal of the level L from the first selecting switch E1 is supplied simultaneously through the first product gate H1 and invertor V to the supply branch r of the shift register G. In this way individual flip-flops are set up so that on the first output Q1 of the first flip-flop KO1 is a signal of the level H and on the first outputs Q2, Q3, Q4 of the other flip-flops KO2, KO3, and KO4 is a signal of the level L. By the level H of the signal on the first output Q1 of the first flip-flop KO1, according to the preselected combination No. 2 on the first code switch SA, there is switched only the second transistor switch S2, which activates the second electromagnetic valve Y2. In this way the second distributor R2 is put into a position in which the pressure medium is discharged through the hole 53 from the second pressure cylinder 7, and by the function of spring 83, the piston 71 is shifted to the partition 51 by 4 mm. As the third pressure cylinder 8 forms a rigid whole together with the yoke 28 and basic body 21, the bar 4 with the second holder 41 and the copying roller 42 is shifted in the direction from the last k also by 4 mm, by which the basic distance d between centers of the treating brush 26 and copying roller 42 is increased 4 mm. In this way the treating is set to a width which corresponds with the width of the lasting margin of the shoe upper in the heel part A of its circumference. By the first rotation motion of the carriage through 180° and by the function of the rotating treating brush 26 there is treated the section of the heel part of the lasting margin Z from the initial point A1 (FIG. 2) up to the beginning of the internal side part D. At this moment, by an action of the position element N1, the second position switch F2 switches and by a signal of the level L on its output, a signal of the level H is transferred to the output of the second product gate H2 and on the input of the shaping circuit TO. In this way the shift register G is readjusted so that a signal of the level H from the first output Q1 of the first flip-flop KO1 is transferred to the first output of the second flip-flop KO2 and on the first outputs of the other flip-flops KO1, KO3 and KO4 there is a signal of the level L. The signal of the level H from the first output Q2 of the second flip-flop KO2 passes through the second output P6 of the changeover switch P to the fourth code switch SD. In this way, according to its preselected combination No. 1, only the first transistor switch S1 is switched, which activates the first electromagnetic valve Y1. The first distributor R1 is changed over into the position in which the pressure medium is discharged through the hole 52 from the first pressure cylinder 6. By the action of the springs 83 the piston 61 is shifted to the partition 51 by 2 mm. The bar 4 with the second holder 41 and copying roller 42 is shifted 2 mm and the basic distance d is increased 2 mm.

During this shifting movement of the carriage, the whole external side part D of the lasting margin of the shoe upper is roughened. At the end of this shifting movement of the carriage, the second position switch F2 is switched, but now by an action of the position element N2. In this way a signal of the level H is transferred again to the input of the shaping circuit TO. Now the shift register G is changed over so that on the first output Q3 of the third flip-flop KO3 there is the pulse of the level H and on the first outputs Q1, Q2, and Q4 of the other flip-flops KO1, KO2, and KO4 there is a pulse of the level L. By the pulse of the level H there is switched, according to the selected combination No. 6, of the code switch SC, the second and third transistor switch S2 and S3. By an action of the electromagnetic valves Y2, Y3 and distributors R2, R3, the pressure medium is discharged from the second and third pressure cylinder 7 and 8. By an action of the springs 83, both pistons 71, 81 with the piston rod 72 are shifted into the opposite dead point and the bar 4 with the second holder 41 and copying roller 42 is shifted in the direction from the last k by 12 mm. The basic distance d is thereby increased 12 mm. Now the unshown carriage performs the second rotation movement through 180°, and in this way the whole toe cap part C of the lasting margin Z of the shoe upper is roughened. At the end of this rotation movement, the first position switch F1 is switched by an action of the position element N3. In this way, the shaping circuit TO is activated and clock pulses of the level H change over the shift register G so that on the first output Q4 of the fourth flip-flop KO4 there is a pulse of the level H and on the first outputs Q1, Q2, Q3 of the other flip-flops KO1, KO2, and KO3 there is a pulse of the level L. The pulse of the level H is supplied through the first output P5 of the changeover switch P to the second code switch SB, according to its preselected combination No. 4, there is activated only the third transistor switch S3 and the third electromagnetic valve Y3. The third distributor R3 is changed-over in this way into the position in which the pressure medium is discharged from the third pressure cylinder 8, the piston 81 of which is shifted together with the piston rod 72, cylindrical body 5, bar 4 and second holder 41 by 8 mm in the direction from the last k. The basic distance of the copying roller 42 is increased in this way 8 mm. By the following reverse movement of the carriage, the whole external side part B of the lasting shoe upper is roughened. Before finishing this movement of the carriage, the first position switch F1 switches again, but now by an action of the position element N4. In this way the shaping circuit TO switches, and clock pulses of the level H shift the shift register G so that a pulse of the level H appears on the first output of the first flip-flop KO1 which switches again the first code switch SA, and according to its preselected combination No. 2 switches only the second transistor switch S2 and the second electromagnetic valve Y2. So at the end of the reverse movement of the carriage the remaining section of the heel part A of the lasting margin Z of the shoe upper is roughened up to the initial point A1. In this way, the working cycle of the treating machine is finished.

For the roughening the lasting margin of the left shoe, the operator switches to the second selecting switch E2. In this way the carriage of the last k is put into the first rotating movement and a signal of the level L is supplied to the second input R of the RS circuit M, which is changed over in this way so that on its first output Q is a pulse of the level L and on the second output (not) Q there is a pulse of the level H. The changeover switch P is changed over in this way so that a pulse of the level H on its third input P3 may pass to the first output P5 and a pulse of the level H on the fourth input P4 may pass to the second output P6. By the signal of the level L from the second selecting switch E2, through the first product gate H1, invertor V and supply branch r, the shift register G is changed over so that on the first output Q1 of the first flip-flop KO1 a pulse of the level H takes place, on the first outputs Q2, Q3, and Q4 of the other flip-flops KO2, KO3, and KO4 there is a pulse of the level L. The pulse of the level H switches the first code switch SA and according to its preselected combination No. 2 it switches again only the transistor switch S2. And in this way, simultaneously as with the above described right shoe, there is roughened the section of the heel part A (FIG. 3) of the lasting margin Z of the shoe upper from the initial point A1 up to the beginning of the external side part B. At this moment, the first position switch F1 is switched by an action of the position element N4. The pulse of the level H from the shaping circuit TO changes over the register G so that the pulse of the level H is transferred to the first output of the second flip-flop KO2. By the level H of this pulse, through the first output P5 of the changeover switch P, the second code switch is switched, which, according to its preselected combination No. 4, switches only the third transistor switch S3. In this way, the copying roller 42 moves by 8 mm from the last k, and the whole external side part B of the lasting margin Z of the shoe upper is roughened. By switching the first position switch F1, caused by the position element N3, the working cycle goes on in the treatment of the toe cap part C of the lasting margin Z as with the right shoe. At the end of treatment of this part C of the lasting margin Z, the other position switch F2 is switched by an action of the position element N2, and by the pulse of the level H from the shaping circuit TO there is changed over the shift register G so that the pulse of the level H is transferred only to the first output Q4 of the fourth flip-flop KO4. In this way, through the second output P6 of the changeover switch P, the fourth code switch SD is switched, and according to the preselected combination No. 1 the whole internal side part D of the lasting margin Z is roughened. By an action of the position element N1, the second position switch F2 is switched again. By a pulse of the level H from the shaping circuit TO, the shift register is set up so that the first code switch SA is switched again and according to its preselected combination No. 2 the remaining section of the heel part A of the lasting margin Z up to the initial point A1 is roughened.

The invention may be advantageously applied when designing a machine for roughening a lasting margin of a tightened shoe upper.

Although the invention is illustrated and described with reference to one preferred embodiment thereof, it is to be expressly understood that it is in no way limited to the disclosure of the such preferred embodiment, but it is capable of numerous modifications within the scope of the appended claims.

We claim:

1. A device for controlling movement of a copying roller of a roughing machine relative to a treating brush for roughening a lasting margin of a tightened shoe upper, comprising a holder for the copying roller, which is slidably seated in a basic body of a treating head;

the basic body of the treating head being connected by means of a swing arm to a machine frame and the holder of the copying roller being terminated by a head, in which head there is seated a cylindrical body with two pressure cylinders with pistons;

the piston of the first of said two pressure cylinders being connected by means of a common piston rod to a piston of a third pressure cylinder, the piston of the second of said two pressing cylinders being in contact with said head by means of a piston rod, the third pressure cylinder piston is connected by means of a yoke to the basic body;

each of said pressure cylinders being individually connected to a distributor of a pressure medium, each distributor being controlled by an electromagnetic valve, each valve being electrically connected to each of four code switches;

two of said four code switches each being connected by input through a changeover switch to first outputs of respective flip-flops and controlled by selecting switches through an RS circuit, and the other two of said four code switches each being connected by inputs directly to first outputs of respective flip-flops, all of said flip-flops being connected to form a common shift register, the set input of one flip-flop being parallelly connected to reset inputs of the other flip-flops by means of an input branch, to which input branch there is connected an output of a first product gate, the inputs of said first product gate being connected both to outputs of the selecting switches and to outputs of the RS circuit;

clock inputs of said flip-flops being interconnected to a collecting branch, to which there is connected an output of a shaping circuit, an input of said shaping circuit being connected to an output of a second product gate;

inputs of said second product gate being connected to position switches, said position switches being activated by corresponding position elements arranged on bars of a carriage of the tightened shoe upper, whereby the pressure cylinders may be selectively actuated singly or in combination so as to control the displacement of the copying roller relative to the treating brush.

2. A device as in claim 1, wherein the strokes of said pistons are of proportions 1:2:4.

3. A device as in claim 1, wherein the electromagnetic valves are connected to the code switches through transistor switches and through diodes.

* * * * *